United States Patent [19]

Demuth et al.

[11] 4,448,244

[45] May 15, 1984

[54] HEAT-TRANSMITTING DEVICE FOR HEAT PUMPS

[75] Inventors: Hans Demuth, Voehringen; Peter Kropp, Nersingen; Karl Noll, Illerrieden, all of Fed. Rep. of Germany

[73] Assignee: Wieland-Werke AG, Ulm, Fed. Rep. of Germany

[21] Appl. No.: 499,615

[22] Filed: May 31, 1983

Related U.S. Application Data

[62] Division of Ser. No. 300,858, Sep. 10, 1981, Pat. No. 4,406,137.

[30] Foreign Application Priority Data

Sep. 17, 1980 [DE] Fed. Rep. of Germany ..... 3034965

[51] Int. Cl.[3] ..... F25B 15/00

[52] U.S. Cl. ..... 165/141; 62/238.6

[58] Field of Search ..... 165/141; 62/238.6, 187, 62/506

[56] References Cited

U.S. PATENT DOCUMENTS

| | | | |
|---|---|---|---|
| 2,445,115 | 7/1948 | Hanrahan | 165/141 |
| 2,456,775 | 12/1948 | Fausek et al. | 165/141 |
| 2,870,997 | 1/1959 | Soderstrom | 165/141 |

*Primary Examiner*—Lloyd L. King

*Attorney, Agent, or Firm*—Flynn, Thiel, Boutell & Tanis

[57] ABSTRACT

A heat-transmitting device is adapted for use in a heat pump system which typically includes a throttle device, an evaporator, a compressor, and a further heat-transmitter device. The heat-transmitting device has a core tube coaxially disposed in a tubular shell. The region between the core tube and tubular shell is divided into two annular spaces by an annular ring sealingly disposed between the core tube and tubular shell. Each annular space serves as an independent condenser. Openings are provided in the tubular shell at each end thereof and on each side of the annular ring to facilitate fluid flow through the device. In the heat pump system, a cooling medium flows through one annular space of the device, then through the further heat transmitter, and then through the other annular space of the device. Heat is transferred by the device from the cooling medium to a fluid flowing through the core tube.

16 Claims, 3 Drawing Figures

HEAT-TRANSMITTING DEVICE FOR HEAT PUMPS

This is a division of application Ser. No. 300,858, filed Sept. 10, 1981, now U.S. Pat. No. 4,406,137.

FIELD OF THE INVENTION

This invention relates to a heat-transmitting device for transmitting heat between a cooling medium and a liquid which is separate from the cooling medium and, more particularly, to such a device adapted for use in the cooling medium circuit of a heat pump which consists substantially of a throttle member, an evaporator, a compressor, two condensers which are connected in series, a further heat transmitter and if desired a collector, wherein the cooling medium is guided after the first condenser, through the further heat transmitter and then to the second condenser.

BACKGROUND OF THE INVENTION

Particularly in small use water heat pumps, the cooling medium is guided, after a first condenser, through a further heat transmitter, in most cases the oil cooler of the compressor in order to absorb its waste heat. Then, in a second condenser, the partly re-evaporated cooling medium is again condensed.

By connecting the condensers in series, additional connection and soldering points become necessary, which increases the danger of leakage of the cooling medium and the task of checking it. In addition, an increased manufacturing cost results.

Therefore, a purpose of the present invention is to provide a heat-transmitting device which consists of condensers and which is constructed more compactly than and substantially avoids the described disadvantages of existing devices.

SUMMARY OF THE INVENTION

This purpose is attained inventively by the condensers being integrated into a coaxial condenser which consists of a core tube and a tubular shell which surrounds the core tube, the annular space between the core tube and the tubular shell being interrupted at one point along the length thereof by a fill member, and openings being provided in the tubular shell next to the fill member.

By inserting a fill member into a conventional coaxial condenser, it is simple to manufacture, depending on the need, different combinations of condensers. According to a preferred embodiment of the invention, the fill member is arranged approximately $\frac{1}{3}$ to $\frac{2}{3}$ of the way along the length of the tubes of the heat-trasmitting device.

The fill member is advantageously constructed as a ring which can be moved easily onto the core tube. Bypasses which develop when using a finned core tube are usually negligible, since in both condensers the same cooling medium is used at almost the same pressure. Nevertheless, if necessary, the bypass effect can be reduced in an advantageous manner by arranging the ring on a nonfinned intermediate portion of the finned core tube.

An axial width of the ring of 5 to 40 mm. is preferred. The ring is preferably made of metal or of a plastic which will tolerate the cooling medium.

In order to prevent movement of the ring from a selected position, it is suggested that the ring be fixed on the core tube. In the case of a metal ring and when using a finned core tube, the ring is internally grooved, which occurs in a simple manner through an impact with a tool on the ring. In the case of a plastic ring, it is suggested that the ring be provided with holding noses which are directed inwardly toward the core tube, which noses can engage the grooves of the finned core tube.

The heat-transmitting device is advantageously designed straight or curved. The curved embodiments are preferably wound U-shaped, meandering, spiral-shaped or helically, and in particular flat-ovally.

BRIEF DESCRIPTION OF THE DRAWINGS

The invention will be discussed in greater detail in connection with the following exemplary embodiments, in which.

DETAILED DESCRIPTION

Figure 1:
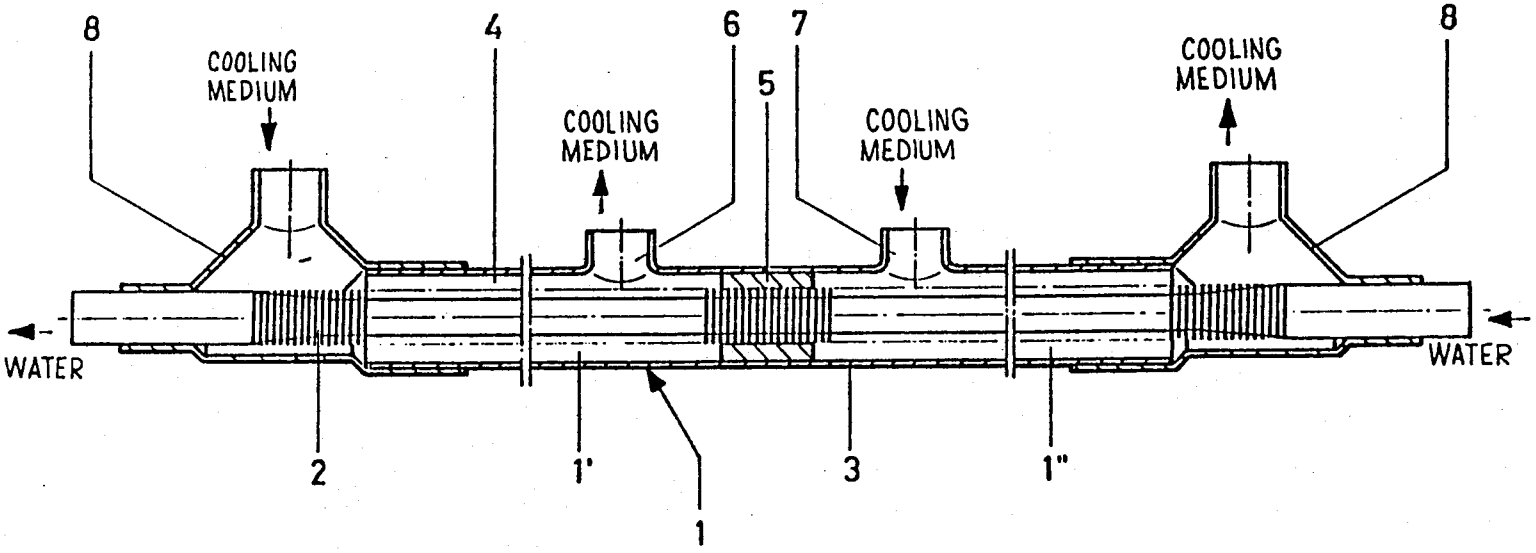
FIG. 1 is a longitudinal cross-sectional view of an inventive heat-transmitting device in straight form with a finned core tube.

The heat-transmitting device 1 in extended or straight form according to FIG. 1 consists substantially of a finned core tube 2 and a tubular shell 3 which coaxially surrounds the finned core tube 2. The annular space 4 between the core tube 2 and the tubular shell 3 is interrupted by a metallic ring 5 located approximately $\frac{1}{3}$ to $\frac{2}{3}$ of the way along the length of the heat-transmitting device 1.

Openings 6 and 7 for a cooling medium are provided in the shell 3 next to and on opposite sides of the ring 5. T-connections 8 with openings for a cooling medium are provided in a conventional manner at the ends of the shell 3. Two condensers 1' and 1'' are in this manner integrated into the heat-transmitting device 1. The cooling medium flows in both parts of the annular space 4 and a liquid, here water, flows in the core tube 2.

Figure 2:
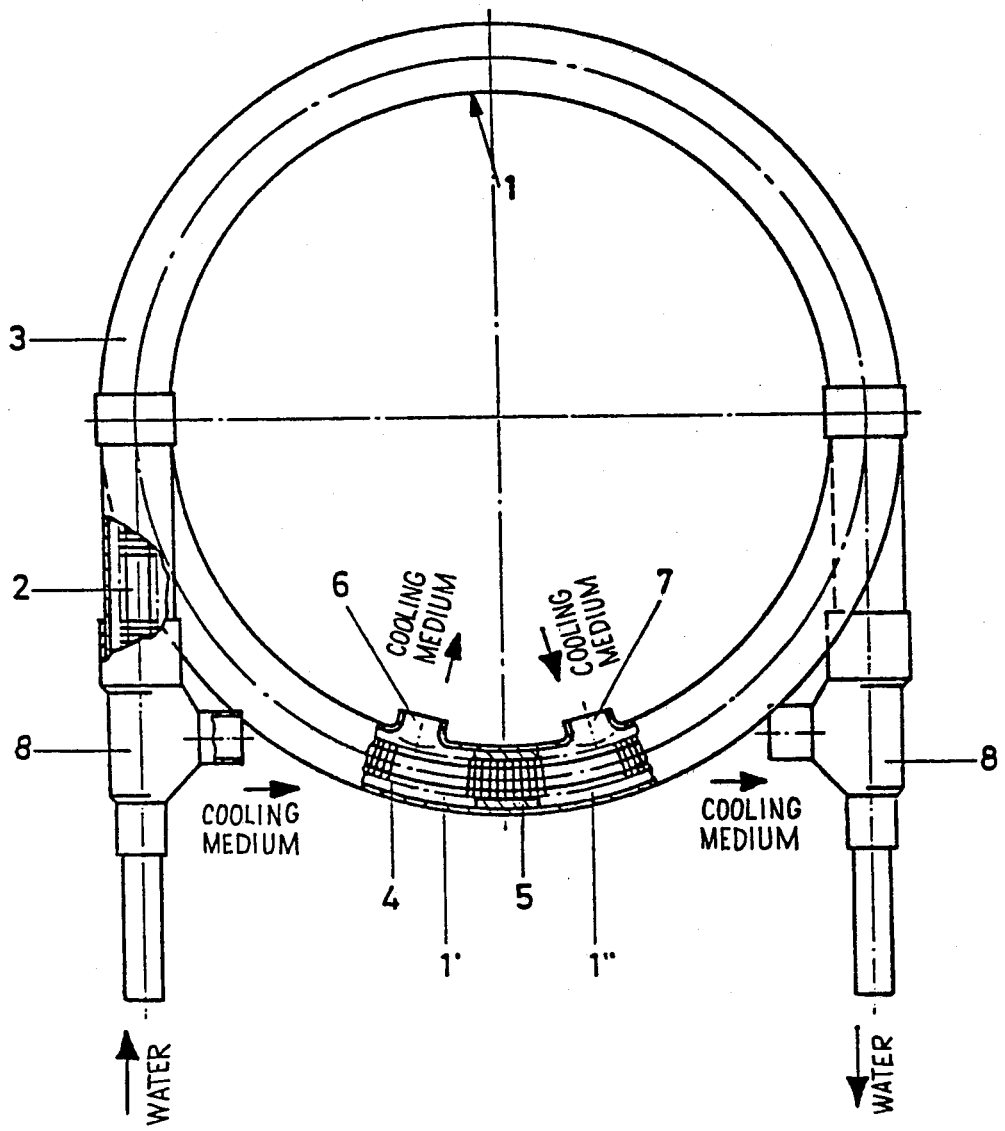
FIG. 2 is a fragmentary top view of a helically wound heat-transmitting device with a finned core tube.

FIG. 2 illustrates a heat-transmitting device similar to that of FIG. 1, except that it is helically wound.

Figure 3:
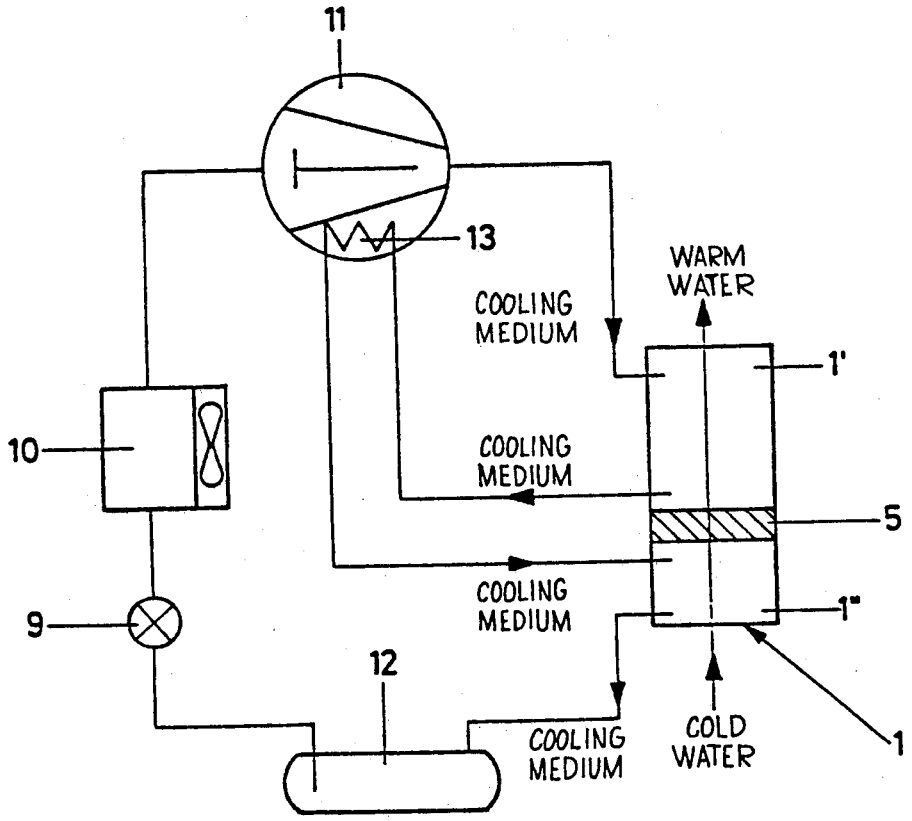
FIG. 3 is a schematic view illustrating a system diagram of a use water heat pump with the inventive heat-transmitting device connected.

The heat-transmitting mechanism 1 can be used in the use water heat pump according to FIG. 3, consisting of a throttle member 9, here an expansion valve, an evaporator 10, a compressor 11, the heat-transmitting mechanism 1, a collector 12 and a further heat transmitter 13, here the oil cooler of the compressor 11. The cooling medium flows through the annular space 4 of the condenser 1', flows through the heat transmitter 13 and absorbs the waste heat of the compressor 11 through a partial, repeated evaporation, and then flows through and condenses in the second condenser 1''. The cold water which flows through the core tube 2 in a direction opposite the cooling medium flow is heated by the heat emitted by the cooling medium.

EXAMPLE

A helically wound heat-transmitting device 1 was manufactured from Cu tubes. The finned core tube 2 had an inside diameter of 13 mm. and a fin height of 1.5 mm., and the tubular shell had a diameter of 25 mm. and a wall thickness of 1 mm. The extended length of the tubes 2 and 3 was approximately 4000 mm. The number of the windings was 4.5, the winding diameter being approximately 280 mm. After approximately 3 windings, a metal ring 5 of approximately 20 mm. width was installed in the annular space 4. Connections 6 and 7 having diameters of 10 mm. were soldered in front of and after the installed ring 5, and the ends of the tube 3 were provided with T-piece connections 8. The use of this heat-transmitting device 1 in a use water heat pump with a cooling medium R12 or 22 produced good results.

Although particular preferred embodimemts of the invention have been disclosed in detail for illustrative purposes, it will be recognized that variations or modifications of the disclosed apparatus, including the rearrangement of parts, lie within the scope of the present invention. For example, the heat-transmitting device of FIG. 1 could be bent into a number of other shapes, such as a U-shape, and could be wound in a planar spiral.

The embodiments of the invention in which an exclusive property or privilege is claimed are defined as follows:

1. A heat transmitting apparatus, comprising an elongate tubular shell, an elongate core tube adapted to have a medium flow therethrough and extending through said shell lengthwise thereof, a closed space being defined between the interior surface of said shell and the exterior surface of said core tube, a fill member which is disposed in and divides said space into separate first and second portions which are located on opposite sides of said fill member, and means defining first, second, third and fourth openings through said shell, said first and third openings communicating with said first portion of said space and said second and fourth openings communicating with said second portion of said space, said first and second openings being adjacent said fill member and said third and fourth openings being spaced from said fill member.

2. The heat-transmitting apparatus according to claim 1, wherein said fill member is located approximately $\frac{1}{3}$ to $\frac{2}{3}$ of the way along the length of said shell from one end thereof.

3. The heat-transmitting apparatus according to claim 1, wherein said closed space is annular and surrounds said core tube, and wherein said fill member is a ring.

4. The heat-transmitting apparatus according to claim 3, wherein said ring is arranged on an intermediate portion of said core tube, and wherein a portion of said core tube within said shell other than said intermediate portion has fins on the exterior thereof.

5. The heat-transmitting apparatus according to claim 3, wherein said ring has an axial width of from 5 to 40 mm.

6. The heat-transmitting apparatus according to claim 3, wherein said ring is made of metal.

7. The heat-transmitting apparatus according to claim 3, wherein said ring is made of a plastic material.

8. The heat-transmitting apparatus according to claim 3, wherein said ring is fixed against axial movement with respect to said core tube.

9. The heat-transmitting apparatus according to claim 8, wherein said core tube has fins on the exterior thereof and said ring is made of metal and is internally grooved, said grooves receiving respective said fins therein.

10. The heat-transmitting apparatus according to claim 8, wherein said core tube has fins on the exterior thereof and said ring is provided with holding noses which extend toward said core tube and are received between said fins.

11. The heat-transmitting apparatus according to claim 1, wherein said elongate shell is substantially straight.

12. The heat-transmitting apparatus according to claim 1, wherein said elongate shell is curved.

13. The heat-transmitting apparatus according to claim 12, wherein said elongate shell is U-shaped.

14. The heat-transmitting apparatus according to claim 12, wherein said elongate shell is coiled in one of a spiral and a helical shape.

15. The heat-transmitting apparatus according to claim 14, wherein said elongate shell is wound in an oval shape.

16. The heat-transmitting apparatus according to claim 1, wherein said elongate shell and said core pipe are substantially cylindrical and said core pipe is substantially coaxially positioned within said shell.

* * * * *